US006868653B2

(12) United States Patent
Ballestrazzi et al.

(10) Patent No.: US 6,868,653 B2
(45) Date of Patent: Mar. 22, 2005

(54) ALIGNING DEVICE AND METHOD FOR FEEDING PRODUCTS INTO AN AUTOMATIC PACKAGING MACHINE

(75) Inventors: Aris Ballestrazzi, Savignano Sul Panaro (IT); Lamberto Tassi, Savignano Sul Panaro (IT)

(73) Assignee: Sitma S.p.A., Spilamberto-Modena (IT)

( * ) Notice: Subject to any disclaimer, the term of this patent is extended or adjusted under 35 U.S.C. 154(b) by 0 days.

(21) Appl. No.: 10/680,044

(22) Filed: Oct. 7, 2003

(65) Prior Publication Data

US 2004/0068965 A1 Apr. 15, 2004

(30) Foreign Application Priority Data

Oct. 14, 2002 (IT) ..... MI2002A2177

(51) Int. Cl.[7] ..... B65B 35/50

(52) U.S. Cl. ..... 53/447; 53/443; 53/147; 198/418; 198/741

(58) Field of Search ..... 53/447, 443, 147; 198/418, 419.1, 744, 741

(56) References Cited

U.S. PATENT DOCUMENTS 2,502,374 A 3/1950 Gilowitz
4,502,592 A 3/1985 Ramcke
5,860,643 A 1/1999 Moser et al.
2004/0045794 A1 * 3/2004 Connelly et al.

FOREIGN PATENT DOCUMENTS

| | | |
|---|---|---|
| DE | 11 98 288 | 8/1965 |
| EP | 0 373 331 | 6/1990 |
| EP | 1 231 168 | 8/2002 |

OTHER PUBLICATIONS

EPO Search Report.

* cited by examiner

*Primary Examiner*—Scott A. Smith
*Assistant Examiner*—Gloria R. Weeks
(74) *Attorney, Agent, or Firm*—Hedman & Costigan, P.C.

(57) ABSTRACT

Device and method for the alignment of stacked products to be wrapped such as newspapers, magazines and books, with or without inserts, of any thickness or size. Sheet placers feed products into the device via a conveyor system equipped with pushers, set at predetermined positions. The products are aligned by engaging elements that rotate through a slot inside of which the conveyor pushers also slide. The engaging elements decrease in speed as they intercept the products, and align the products with the conveyor pushers as they are transported along the conveyor to a packaging area.

6 Claims, 3 Drawing Sheets

ALIGNING DEVICE AND METHOD FOR FEEDING PRODUCTS INTO AN AUTOMATIC PACKAGING MACHINE

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

The present invention relates to an aligning device and method for feeding products into an automatic packaging machine.

In the field of publishing products, packaging machines currently receive a range of these publishing products such as envelopes, newspapers, magazines, books, with or without included gadgets, and they place said products in position, neatly wrapped in plastic film or paper.

In order to perform this operation, said products, such as a newspaper including relative inserts or additional gadgets, must be fed correctly aligned and stacked with suitable sheet placers or similar devices. This requirement is necessary to facilitate the following wrapping action and to obtain correct wrapping results, where the products in the package are neatly stacked to occupy the least possible space.

Naturally it must be taken into consideration that all wrapping action is performed automatically. In fact, the various products listed above stacked between suitable sheet placers or similar devices, are sent forward towards a conveyor that transfers them to the following area for wrapping in plastic film or paper.

The conveyor system is generally composed of a pusher conveyor whereon the pushers are arranged at a certain distance one behind the other with a step that can be set in advance. The pushers move forward until they are in contact with the product or stack of products that are fed gradually until they make up the contents of the final package.

The sheet placers or similar devices that are especially selected for said feeding action are not able to place the fed products in perfectly aligned stacks, partly because of the conveyor motion, and partly because the surface and materials of the products themselves often lead to sliding when in contact with each other, causing them to become misaligned.

This problem is increased when the film is transparent, or when the products in the stack have very different sizes. Moreover, misaligned stacks also require larger quantities of packaging materials in order to contain all the products.

BRIEF SUMMARY OF THE INVENTION

Therefore the general aim of the present invention is to identify and realise an aligning device and method for feeding products into an automatic packaging machine that will resolve the technical problems described above.

Another aim of the invention is to realise a device and method of the aforesaid type that is able to function with any product thickness or size without creating problems.

A further aim of the invention is to realise a device and method of the aforesaid type that maintains correct stacking position in spite of the type of material or product surface.

A further aim of the invention is to realise a device and method that uses a minimum of film or paper while providing precise and correct packaging levels at the same time.

A further aim of the invention is to realise a device that can be easily associated with any type of packaging machine already in use.

A further aim of the invention is to identify a device and method that ensure correct packaging operations while making them as automatic and fast as possible at the same time.

These and other aims according to the present invention have been attained by realising an aligning device and method for feeding products into an automatic packaging machine as illustrated in the appended claim 1.

Further important characteristics of the present invention are described in the dependent claims.

The functional and structural characteristics and the advantages of the device and method according to the invention will be illustrated for greater clarity in the descriptions of the embodiment that is provided as an example but that is to be considered in no way limitative, with reference to the appended drawings wherein:

DETAILED DESCRIPTION OF THE INVENTION

The drawings illustrate the conveyor 11 equipped with pushers 12 that receives publishing products or other products 13, 13', 13", etc, such as newspapers, magazines, books, envelopes, gadgets, or other additional products from sheet placers shown schematically in 14, 14', 14", etc, in an automatic packaging machine for said products, as defined previously for wrapping in plastic film or paper.

An aligning device for said feeding products according to the present invention and identified throughout with the numeral 15, is positioned slightly downstream of each of the sheet placers schematically illustrated in 14, 14', 14", etc.

Figure 2:
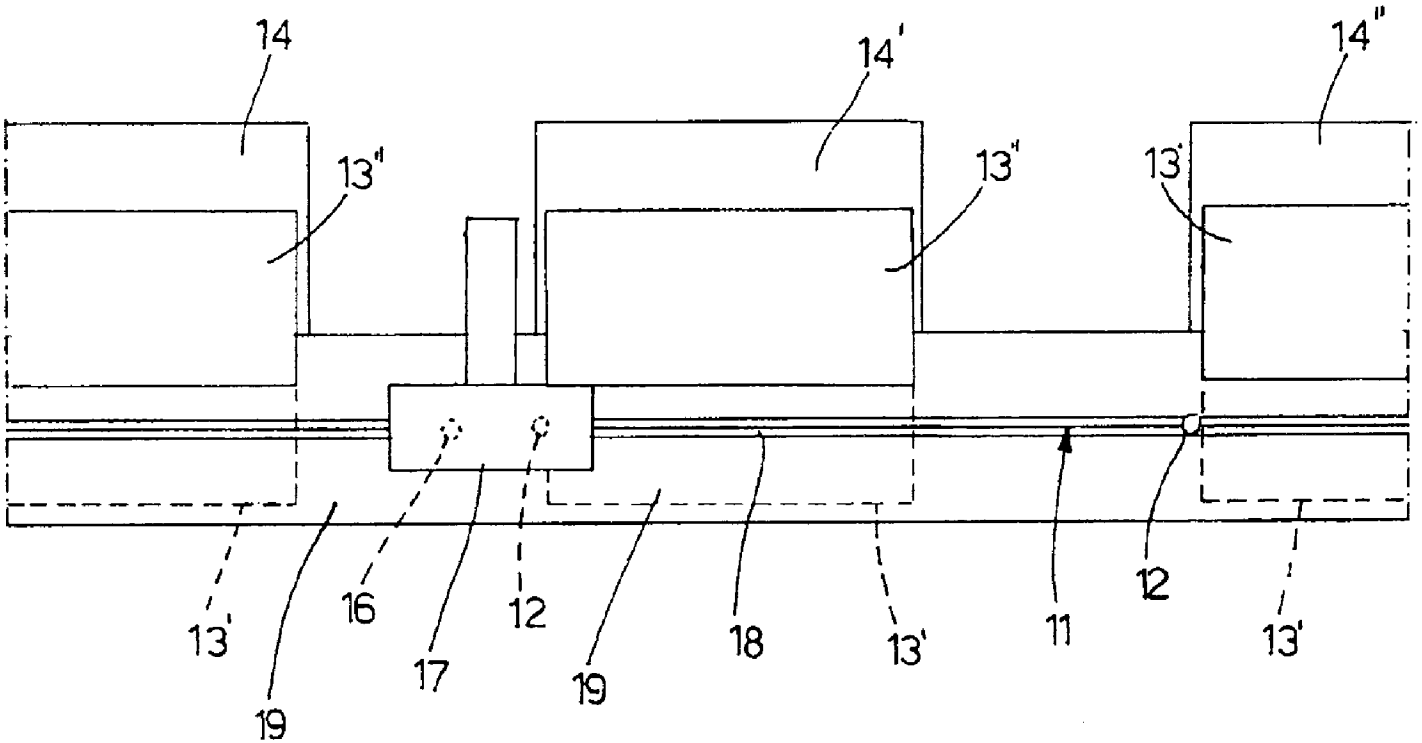
FIG. 2 shows a view from above of the machine illustrated in FIG. 1, FIGS. 3–5 are schematic drawings of side views of the aligning device illustrated in FIG. 1 in successive operating steps.
Figure 4:
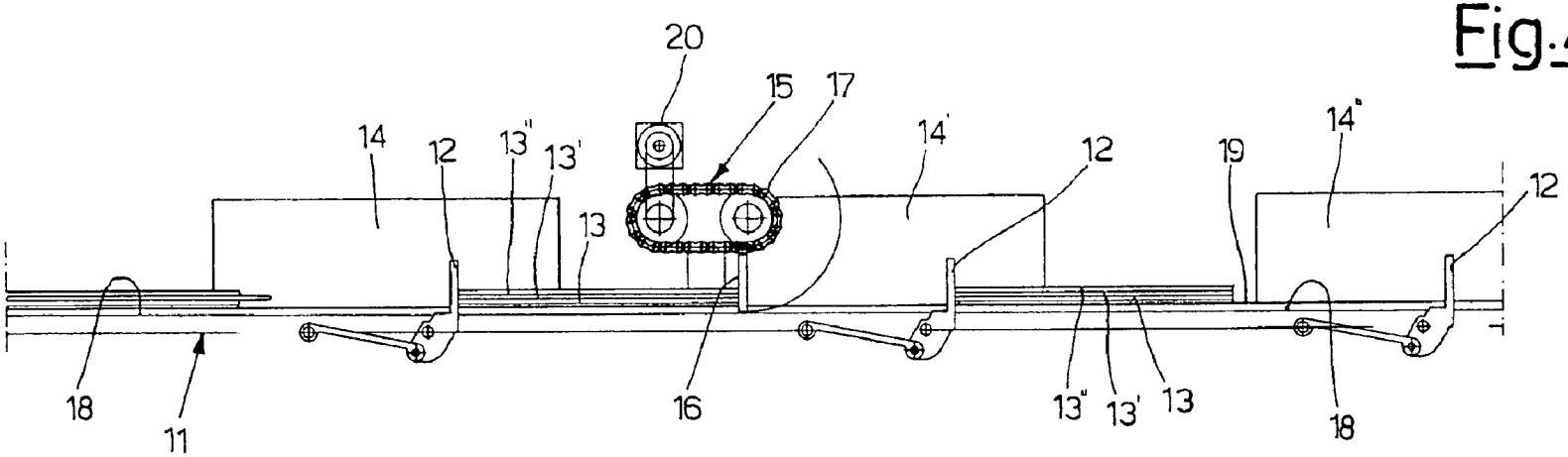
Figure 5:
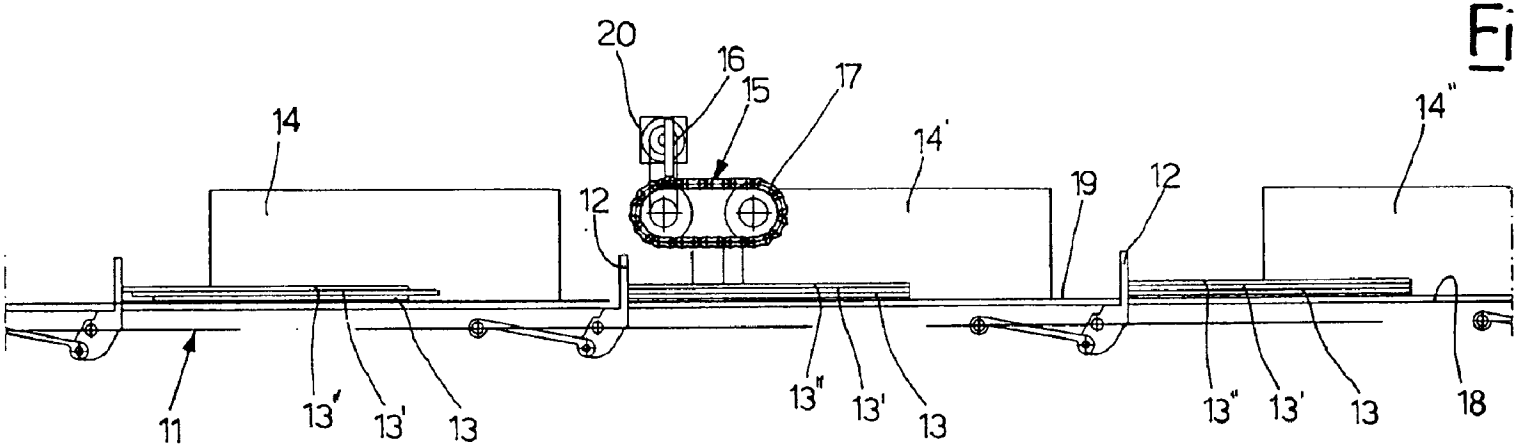

In particular, as shown in the example, the device comprises at least one engaging element, such as a blade 16 or rod, which extends out from a transport belt or chain 17 that move in the same direction as the pushers 12 of conveyor 11 in continuous motion, and that are arranged adjacent to or over the conveyor 11, as shown in FIG. 2. For example, the pushers 12 of conveyor 11 travel forward in a lengthwise slot 18 pulled by a chain positioned underneath the plane surface 19 for sliding the products 13, 13', 13", etc.

The free end of said engaging element 16 is inserted into said lengthwise slot 18 so that it is guided during its motion at variable speed.

Moreover, the engaging element 16 moves into contact with one end of the fed product 13, 13', 13", etc, frontally, that travels forward propelled by the relative pusher 12, as well as one or more further products 13, 13', 13", etc, stacked in a pile, but not aligned with the bottom product.

This way, due to its position in contact with the front end of the product or stacked products, the engaging element 16 aligns said products with the respective pusher 12 which acts on the bottom product, recomposing the stacked position arrangement, and aligning any protruding products that may be out of line with the others in the pile.

Then said engaging element 16 moves away from said products to permit forward travel towards the packaging area or towards another sheet placer.

In particular, the figures illustrate how certain means such as a belt or chain 17 that transports and determines the forward travel of the engaging elements 16, is driven by a variable speed motor 20. The belt or chain 17 can transport more than one engaging element 16.

In this manner the engaging element 16 can also travel at variable speed thus realising the aligning method according to the present invention. In fact, during a first step it descends rapidly in front of the stacked products propelled by the respective pusher 12. Then in a second step, it slows down bringing the engaging element 16 into contact with the most protruding part of at least one of these stacked products that are arrested, at least partially, and placed in contact at the rear with the respective pusher 12. Therefore during a third step it returns to the same speed as the pusher 12 and performs the correct alignment of all products. Last of all during the final step, it accelerates to disappear from its position in front of the products engaged in forward travel to permit their correct motion on the packing line.

Figure 1:
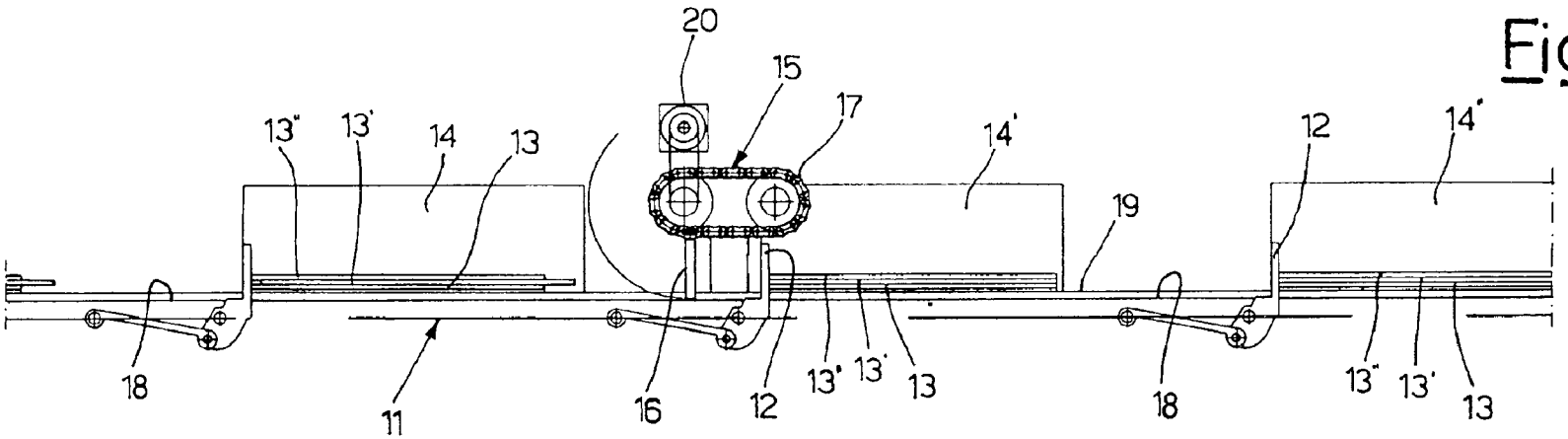
FIG. 1 is a schematic drawing of a side view of an aligning device for products to be fed into an automatic packaging machine, including a section of a pusher conveyor system.
Figure 3:
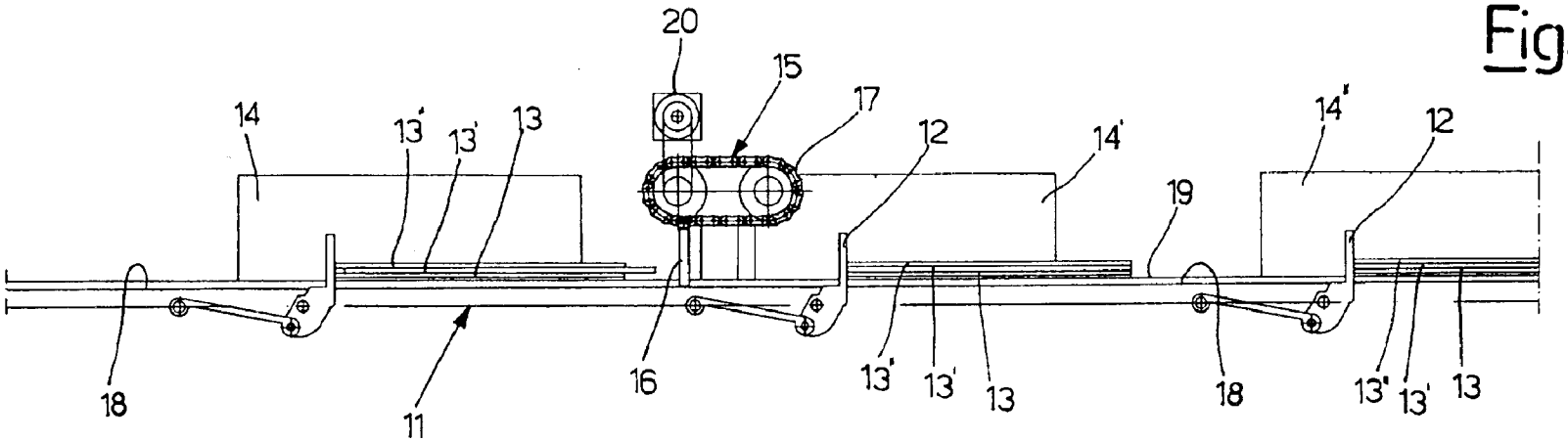

FIG. 1 shows the device 15 in initial intervention position in which the engaging element 16 descends as controlled by the belt 17, to be inserted into the slot 18 in the sliding surface 19, where it stops.

Then the motor 20 accelerates the engaging element 16 a little to a speed slightly less than the pusher 12 forward travel speed. This way, the engaging element 16, at slower speed, makes contact with a product 13', placed in position previously by a sheet placer 14' on top of a first product 13, fed by the sheet placer 14.

The front of product 13' protrudes slightly compared to product 13 positioned underneath it, and is therefore aligned in a backwards direction and placed in contact with the respective pusher 12.

Once this operation has been completed, the engaging element 16 is gradually accelerated at the same speed as conveyor 11, and therefore the same speed as pusher 12, to complete the aligning action with the products positioned underneath, including the parts that protrude most. When this alignment has been completed, the engaging element 16 is removed rapidly from the position in front of products 13, 13' to permit easy forward travel, propelled by pusher 12.

In addition, the engaging element 16 is immediately ready for repositioning in front of the next two products to be aligned.

Naturally it is obvious that a device of this type is mounted downstream and adjacent to each sheet placer in order to control the product stacks as they are formed with the addition of new products that are foreseen for inclusion in the final packaging.

The respective aligning device will intervene to recompose the stack in correct form for each additional and potentially protruding product misaligned in a vertical direction in the stack under composition.

Packaging operations performed using these devices or applying the methods described in the present invention result as being free of all the problems that previously limited functionality and correct packaging.

In fact, elimination of protruding product parts in stacks under composition does not interfere with the automatic processing of stacked products, and prevents excess use of plastic wrapping and possible handling machine jamming.

In fact, thanks to the product aligning device, the plastic film or paper adheres completely to the wrapped products creating a package that has a pleasant appearance and that is efficiently packed.

Moreover, if inserts or other products are included in the package, they remain efficiently blocked inside the film or paper that adheres to all the contents, assuming the same shape and blocking them in position.

The use of this device and method for aligning machine fed products also involves a considerable saving in wrapping film or paper during packaging, reducing consumption to a minimum. When calculated for large quantities, this saving reduces packaging costs considerably.

It should also be remembered that said device can be installed easily even on existing packaging machines. In fact, assembly is reduced to simply mounting the device components without having to intervene on the machine structure.

Naturally the term "product" refers to a packaged or non-packaged product, whether single or composed of several items, with variable thickness and size, that must be wrapped in plastic film or paper. Moreover, as stated above, the basic product such as a newspaper, a magazine, a book, or other product, can be combined with at least a second product, with the same or different measurements, that acts as an additional element such as any type of gadget, a compact disk, a floppy disk, a perfume, or any other object of a reasonably small size.

The device and method described in the present invention can be subject to numerous modifications and variants while remaining within the concept of the invention.

Moreover, basically all materials used, in any size or with any components, can be of any type according to technical necessity.

Sequence Listing

Not Applicable

What is claimed is:

1. Aligning device for feeding products (13, 13', 13") stacked on top of each other for transfer to a packaging area for wrapping in plastic film or paper, comprising at least one sheet placer (14, 14' 14") for feeding said products to a conveyor (11) equipped with a plurality of pushers (12), positioned at a distance one behind the other with an adjustment step wherein said device is mounted downstream of said at least one sheet placer (14, 14' 14") having at least one sheet engaging element (16) that is brought into contact with the front end of a fed product during forward travel, and said engaging element extends into a lengthwise slot (18) inside which said conveyor (11) pushers (12) also slide, aligning said product with the respective pusher (12) which is movable away from said product to permit said product to travel towards the packaging area or towards another sheet placer (14, 14' 14").

2. Device according to claim 1 wherein said engaging element (16) is driven by a variable speed motor (20).

3. Device according to claim 2, wherein said motor (20) is associated with a belt or chain (17) that ring winds and that transports at least one engaging element (16).

4. Device according to claim 1, wherein said engaging element (16) is composed of a blade or a rod.

5. A method for aligning products (13, 13', 13") stacked on top of each other for transfer to a packing area for wrapping in plastic film or paper comprising at least one sheet placer (14, 14' 14") for feeding said products to a conveyor (11) equipped with a plurality of pushers (12) positioned at a distance one behind the other with an adjustment step wherein said method comprises a first step, that an engaging element (16), which extends into a lengthwise slot (18) inside which said conveyor (11) pushers (12) also slide, and makes contact with the front end of said stacked products, which are propelled by said conveyor pushers, during a second step said engaging element slows down until it makes contact with a protruding part of said stacked products, aligning them with each other, and then during a third step said engaging element is removed rapidly to permit the forward travel of said aligned stacked products.

6. The method for aligning products according to claim 5, wherein said second step further comprises a slow acceleration step of said engagement element to a speed less than that of said conveyor, and of a gradual acceleration of said conveyor to equalize the length of said products.

* * * * *